US006460965B2

(12) United States Patent
Ikegami et al.

(10) Patent No.: US 6,460,965 B2
(45) Date of Patent: Oct. 8, 2002

(54) INK JET RECORDING HEAD AND INK JET RECORDING DEVICE

(75) Inventors: Koji Ikegami; Tomoki Umezawa, both of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/858,497

(22) Filed: May 17, 2001

(65) Prior Publication Data

US 2001/0043248 A1 Nov. 22, 2001

(30) Foreign Application Priority Data

May 17, 2000 (JP) ..... 2000-145424

(51) Int. Cl.[7] ..... B41J 2/015; B41J 2/05
(52) U.S. Cl. ..... 347/20; 347/65
(58) Field of Search ..... 347/20, 63, 56, 347/65, 47, 42, 85, 54

(56) References Cited

U.S. PATENT DOCUMENTS

| | | | | |
|---|---|---|---|---|
| 5,332,466 A | * | 7/1994 | Nozawa | 347/63 |
| 5,774,152 A | * | 6/1998 | Namba et al. | 347/65 |
| 5,953,023 A | * | 9/1999 | Shimomura et al. | 347/20 |
| 5,975,681 A | * | 11/1999 | Ogaswara et al. | 347/47 |
| 6,007,185 A | * | 12/1999 | Hirosawa et al. | 347/50 |

FOREIGN PATENT DOCUMENTS

| | | | |
|---|---|---|---|
| JP | 4-251748 | 9/1992 | B41J/2/045 |
| JP | 5-38812 | 2/1993 | B41J/2/05 |
| JP | 8-230191 | 9/1996 | B41J/2/05 |

* cited by examiner

*Primary Examiner*—John Barlow
*Assistant Examiner*—Juanita Stephens
(74) *Attorney, Agent, or Firm*—Morgan, Lewis & Bockius LLP

(57) ABSTRACT

The present invention provides an ink jet recording head and an ink jet recording device respectively simply and precisely formed, the ink jet recording head and the ink jet recording device are characterized as follows. For the ink jet recording head, an elastic member is inserted between a head chip and an ink supply member and is pressed upon them by a bolt. As a result, a convex portion of the ink supply member comes into contact with a holding member to which the head chip is fastened and the distance between the head chip and the ink supply member is fixed. Therefore, the compressed amount of the elastic member is fixed, the sealing performance of a connection of an ink supply port of the head chip and a supply passage of the ink supply member is secured and it becomes possible to prevent excessive force from acting upon the head chip and damaging the head chip. Therefore, the ink jet recording head can be provided by a precise and simple method.

15 Claims, 10 Drawing Sheets

INK JET RECORDING HEAD AND INK JET RECORDING DEVICE

BACKGROUND OF THE INVENTION

1. Field of the Invention

The present invention relates to an ink jet recording head and an ink jet recording device that jet an ink droplet on a recording medium to form an image.

2. Description of the Related Art

Recently, an ink jet recording device is drawing attention as a low-cost, quality color recording device. For an ink jet recording head of an ink jet recording device, there are known a piezoelectric type of ink jet recording head that jets ink from a nozzle by pressure generated by mechanically deforming a pressure chamber with a piezoelectric material for example and a thermal ink jet recording head that jets ink from a nozzle with pressure acquired by energizing a heater element arranged in an individual passage and vaporizing ink.

In these ink jet recording heads, a head chip in which an ink jetting mechanism that jets an ink droplet is installed is joined to an end of an ink supply member. Concretely, ink is supplied to an ink supply port provided to the head chip from a pipeline of the ink supply member and is jetted from a nozzle.

In an ink jet recording head related to prior art, since the sealing performance of the contact surface cannot be secured only by combining a head chip and an ink supply member, the head chip and the ink supply member are bonded using an adhesive as disclosed in Japanese Published Unexamined Patent Application No. Hei 5-38812 (hereinafter called conventional example 1) for example to secure the sealing performance of the contact surface.

Also, for an ink jet recording head in which an ink supply member and a head chip are joined without using an adhesive, a junction of the head chip and the ink supply member is made of an organic member and they are joined by ultrasonic fusion as disclosed in Japanese Published Unexamined Patent Application No. Hei 8-230191 (hereinafter called conventional example 2).

Further, for another example, there is an ink jet recording head in which a head chip and an ink supply member are integrated by hot riveting as disclosed in Japanese Published Unexamined Patent Application No. Hei 4-251748 (hereinafter called conventional example 3).

In the conventional example 1, the applied amount and the applied position of an adhesive are required to be strictly managed so that the adhesive is not forced out from the contact surface to a pipeline of the ink supply member and an ink supply port of the head chip or to a nozzle formation surface of the head chip. Therefore, the intricate control of a high accuracy coater, the applied position and the applied amount are required and the cost of the ink jet recording head is increased.

Also, as the coefficients of thermal expansion of the head chip, the ink supply member and the adhesive are different, a crack in the head chip and peeling on the contact surface are caused by thermal stress caused by a heating process in the assembly of the ink jet recording head and the yield in the manufacture of the ink jet recording head is deteriorated.

Also in a method related to the conventional example 2 and the conventional example 3, as the ink supply member and the head chip are heated by ultrasonic fusion and hot riveting, a similar problem due to thermal stress occurs.

Further, in the conventional examples 1 to 3, the ink supply member and the head chip are deformed by heating in joining and ink jetting performance may be deteriorated.

Also, there is a problem that it is difficult to disassemble the inkjet recording head once assembled in any of the conventional examples 1 to 3 and it is difficult to fractionalize every part different in materials for recycling.

SUMMARY OF THE INVENTION

The present invention has been made to solve the problems and provides an ink jet recording head in which a head chip and an ink supply member are precisely joined and an ink jet recording device.

According to an aspect of the present invention, the ink jet recording head includes a head chip in which an ink jetting mechanism for jetting an ink droplet is installed and to which an ink supply port for supplying ink from the outside is supplied, an ink supply member to which a pipeline for supplying ink to the ink supply port is provided and an elastic member which is provided between the ink supply member and the head chip and which seals a connection of the ink supply port and the pipeline by being pressed upon the ink supply member and the head chip.

The pipeline and the ink supply port are connected with a connection securing sealing performance by inserting the elastic member between the head chip and the ink supply member and pressing it upon both. Therefore, an adhesive and others difficult to handle in the assembly of the head are not required and the head can be easily manufactured. Also, as heating is not required for assembly, deformation of the head chip and the ink supply member by heating to cause peeling of the head chip and the ink supply member as well as a negative effect upon the jetting performance of the ink jet recording head are not caused. Particularly, since a difference in deformation among each member is absorbed by deformation of the elastic member even if the coefficient of thermal expansion of each member is different, satisfactory sealing performance of a connection can be secured.

Further, since only the elastic member is inserted between the ink supply member and the head chip, the ink jet recording head can be disassembled into each part and fractionation in recycling is facilitated.

The ink jet recording head may include a regulator that regulates a deformed amount by pressure of the elastic member.

The ink jet recording head may also include a holding member to which the head chip is fixed, and the regulator may be formed in at least one of the ink supply member and the holding member, and it may come into contact with the other member as a contacting part in assembly.

The holding member may also include a guide unit that guides the ink supply member, when the ink supply port is open in the two directions, so that the elastic member is pressed upon the head chip from an intermediate direction of the two directions.

At least two of the head chip, the ink supply member and the holding member may be different in a coefficient of thermal expansion.

The elastic member and the ink supply member may be fabricated and integrated by insertion molding.

According to another aspect of the present invention, the ink jet recording head includes a head chip formed by laminating silicon substrates and provided with a nozzle, an individual passage for supplying ink to the nozzle and a common liquid chamber for supplying ink to plural individual passages, an ink supply member a wall of which is formed next to a wall of the head chip forming the common liquid chamber and which is provided with an ink chamber integrated with the common liquid chamber and an elastic member which is inserted between the head chip and the ink supply member and which seals a connection of the ink chamber and the common liquid chamber.

As the common liquid chamber is substantially large-sized by integrating the common liquid chamber provided to the head chip and the ink chamber provided to the ink supply member, bubbles generated in the common liquid chamber are moved to positions apart from the individual passages. As a result, bubbles can be prevented from blocking the individual passages and lowering ink jetting performance.

Also, since the wall forming the common liquid chamber and the wall forming the ink chamber are formed next to each other, sealing performance by the elastic member becomes satisfactory.

BRIEF DESCRIPTION OF THE DRAWINGS

Preferred embodiments of the invention will be described in detail based on the followings, wherein.

DETAILED DESCRIPTION OF THE PREFERRED EMBODIMENTS

First Embodiment

Referring to FIGS. 1 to 5, an ink jet recording head equivalent to a first embodiment of the invention will be described below. First, a head chip having the ink jet recording head will be described, and then the ink jet recording head in which the head chip is installed will be described.

Figure 1A:
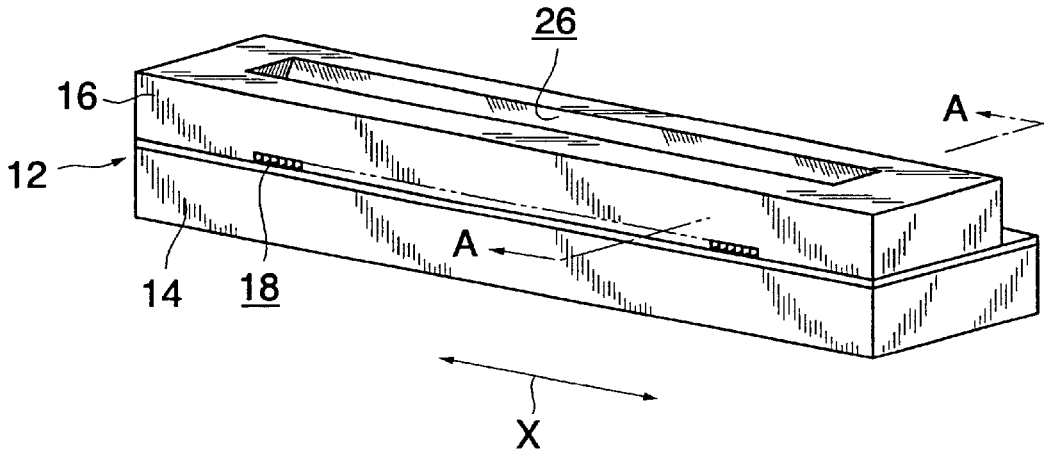
FIG. 1A is a perspective view showing a head chip and an ink supply member in a first embodiment of the invention and FIG. 1B is a perspective view showing the back side of the head chip.
Figure 1B:
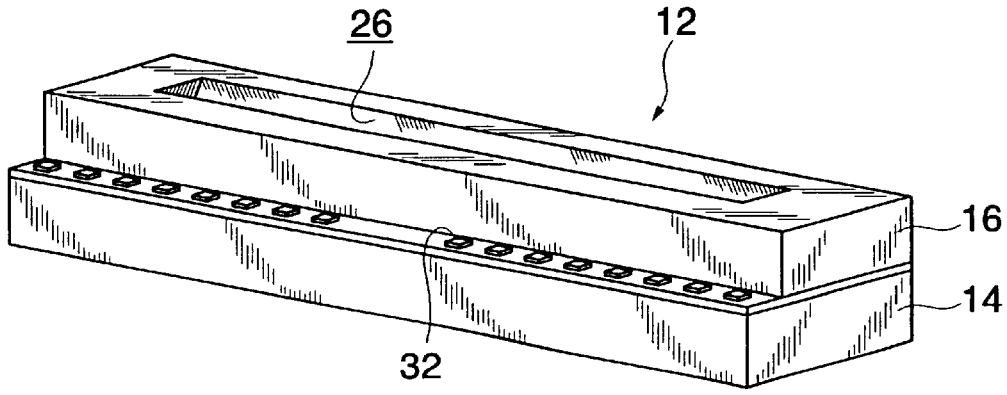
Figure 2:
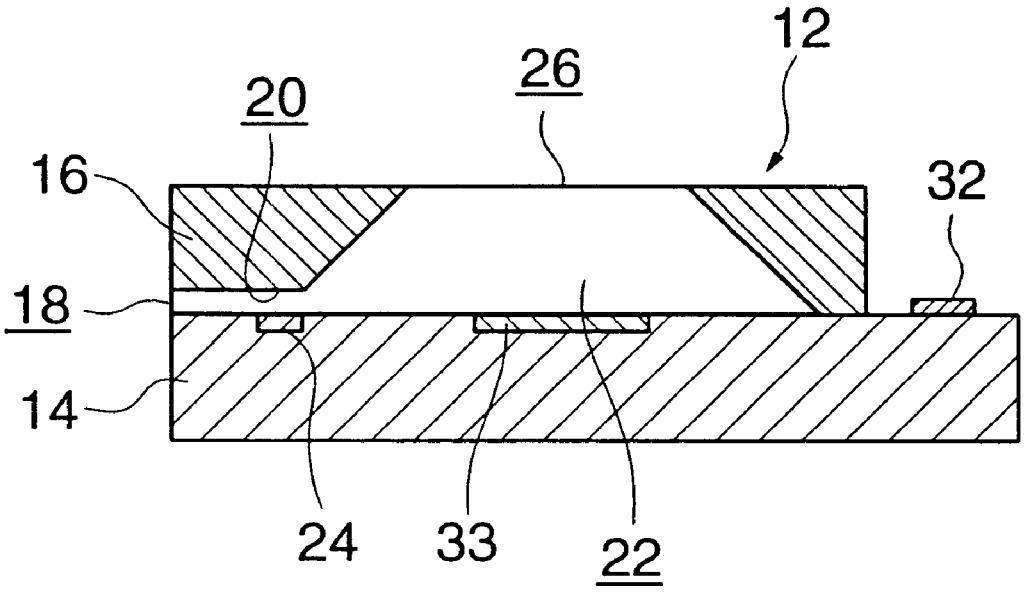
FIG. 2 is a sectional view viewed along the line A—A in FIG. 1A.

As shown in FIGS. 1A, 1B and FIG. 2, the head chip 12 forming the ink jet recording head 10 is made up by joining a heater element board 14 and a passage board 16 respectively formed by minutely working a silicon wafer and is basically made up of plural nozzles 18 formed on one end face, an individual passage 20 communicating with the nozzle 18, a common liquid chamber 22 communicating with all the individual passages 20 and extended in a nozzle arrangement direction and a heater element 24 arranged in the face of the individual passage 20.

The common liquid chamber 22 communicates with each individual passage and is connected to a supply passage 48 of an ink supply member 42 described later via an ink supply port 26 formed in a direction perpendicular to the individual passage 20 (a direction shown by an arrow X).

On the back side of the surface on which the nozzles 18 are formed of the head chip 12, as shown in FIG. 1B, an electric signal input-output terminal 32 is provided. On the side of the common liquid chamber 22 of the heater element board 14, a driving circuit 33 for driving the heater element 24 is provided.

Figure 3:
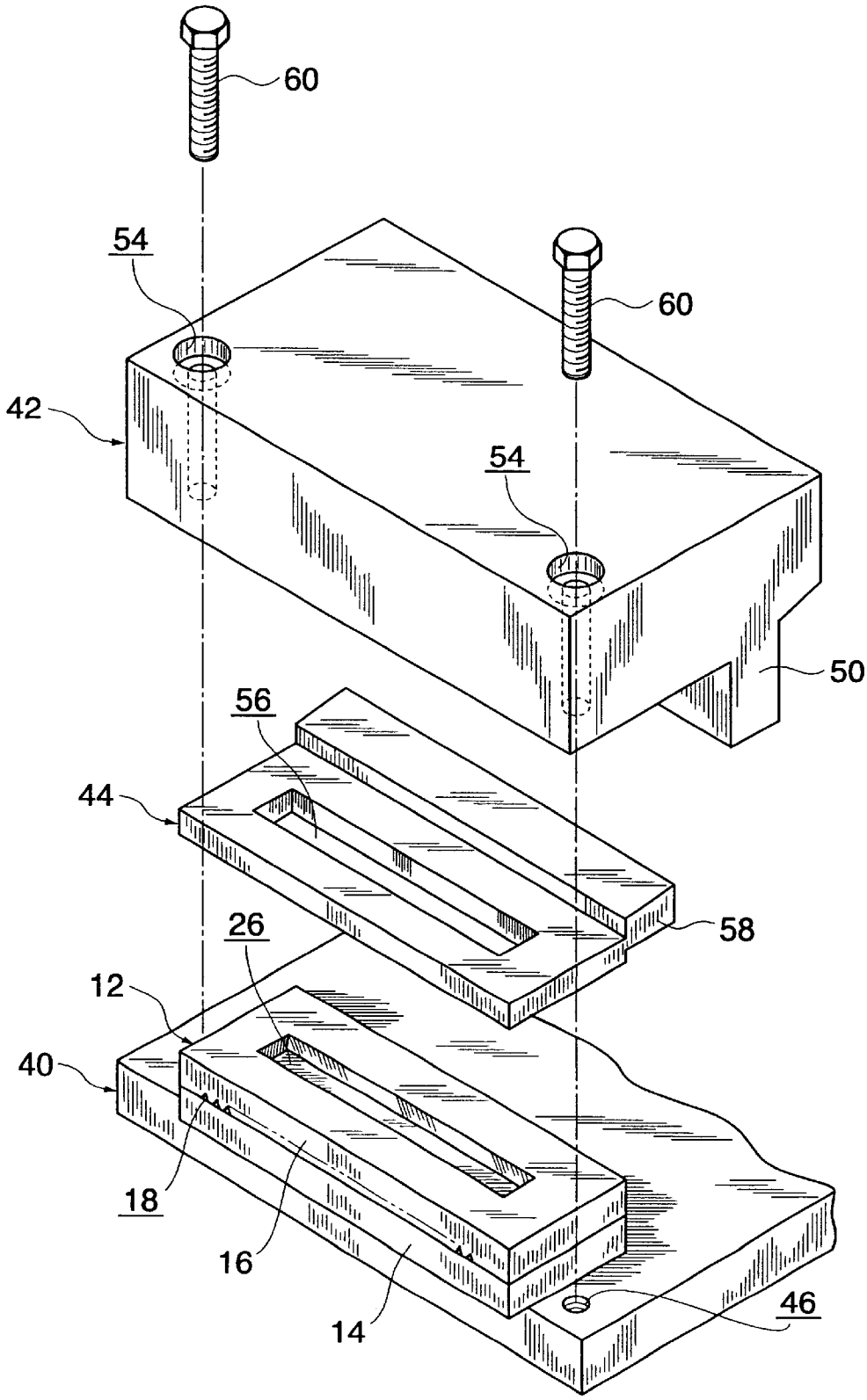
FIG. 3 is an exploded perspective view showing an ink jet recording head equivalent to the first embodiment of the invention.

The head chip 12 made up as described above forms the ink jet recording head 10 by being integrated with a holding member (a heat sink) 40, an ink supply member 42 and an elastic member 44 as shown in FIG. 3.

The holding member 40 is a plate made of aluminum excellent in workability and outgoing radiation. As the head chip 12 and the holding member 40 are bonded by a silicon-modified resin, thermal stress that acts between the head chip 12 and the holding member 40 is absorbed when the temperature of the head chip 12 rises by printing. A tapped hole 46 into which a bolt 60 is screwed is fastened to the holding member 40 at both ends in the longitudinal direction of the head chip 12.

Figure 4:
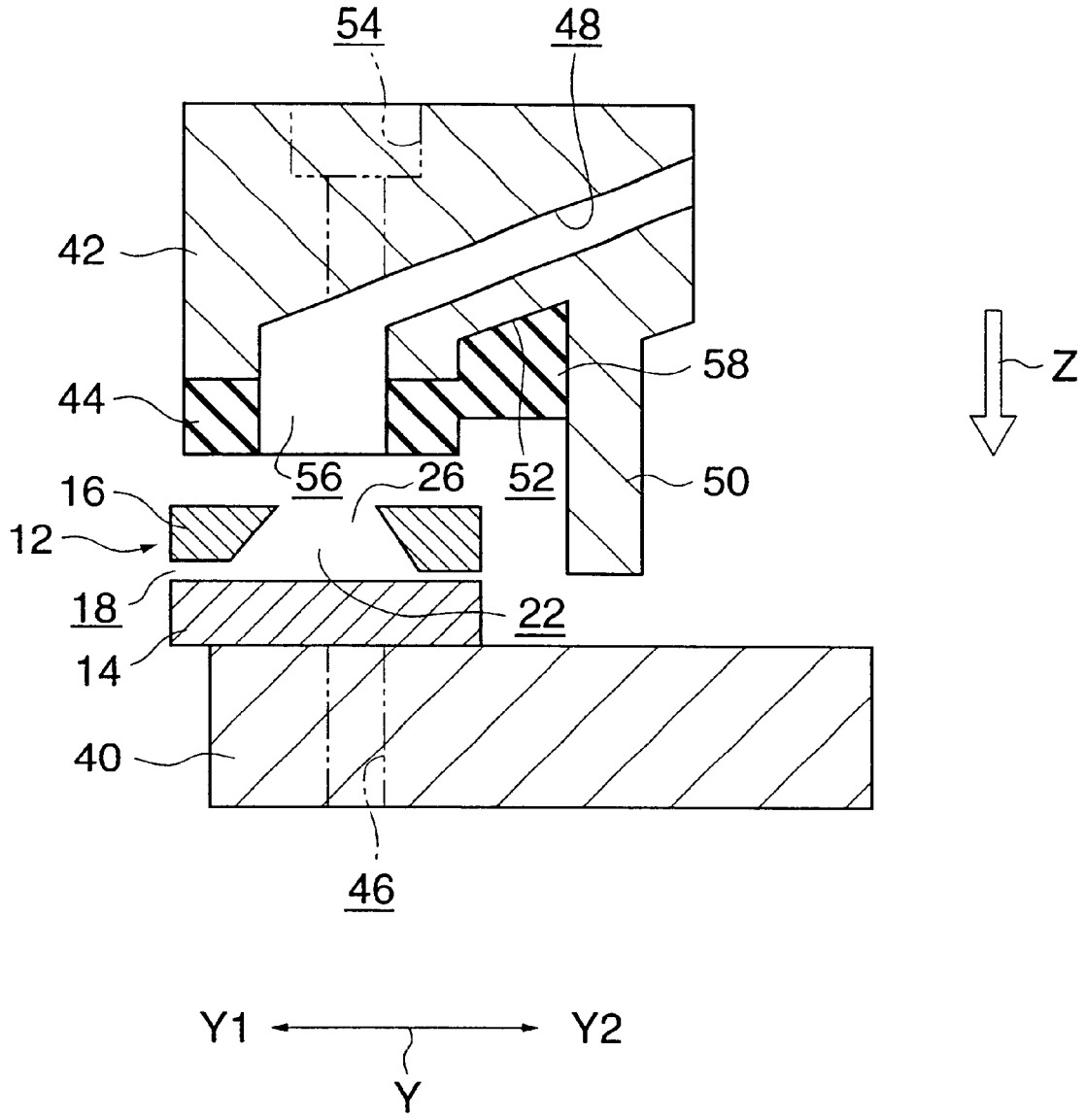
FIG. 4 is an assembly state explanatory drawing showing the ink jet recording head equivalent to the first embodiment of the invention.
Figure 5:
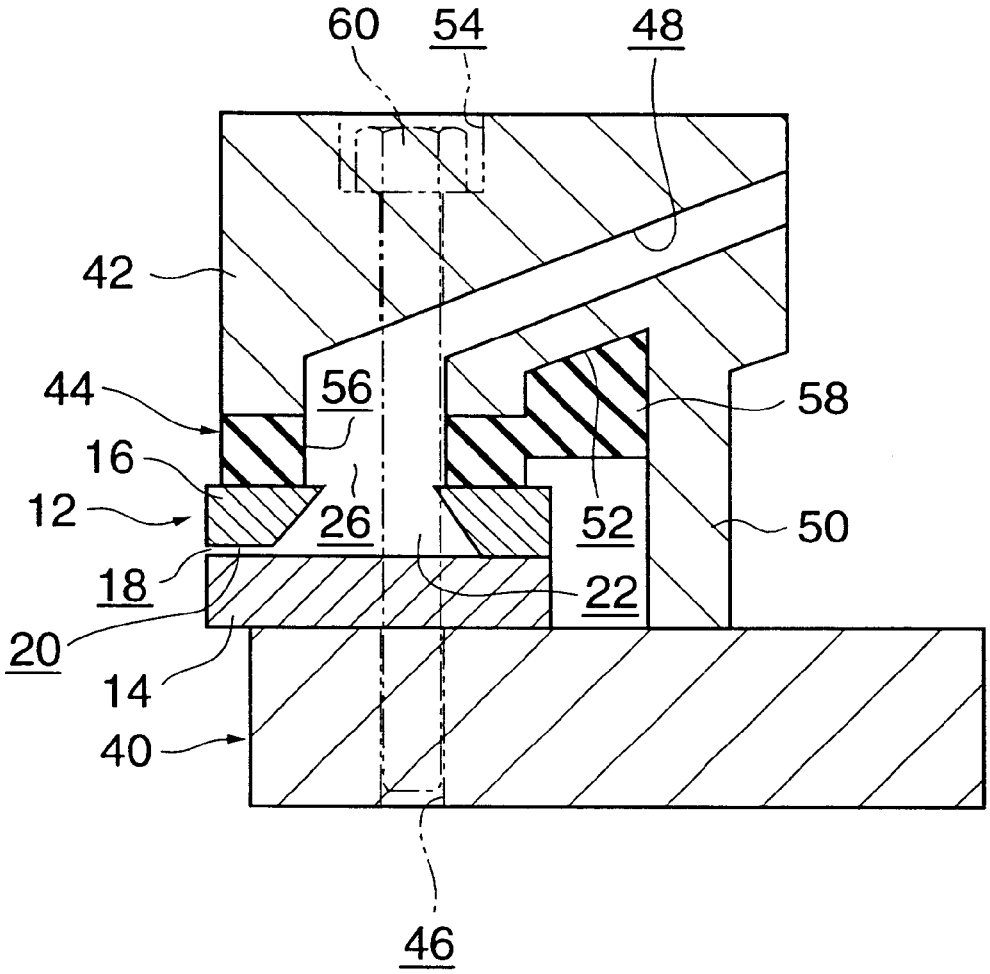
FIG. 5 is a longitudinal section showing the ink jet recording head equivalent to the first embodiment of the invention.

The ink supply member 42 is substantially rectangular as shown in FIGS. 3 and 4, the supply passage 48 connected to the ink supply port 26 of the head chip 12 is formed inside and a convex portion 50 abutted with the holding member 40 in assembly is formed on the side of the rear end (a direction shown by an arrow Y2).

Also, a concave portion 52 into which the elastic member 44 described later is forced is formed on the side of the lower surface of the ink supply member 42 and a bolt insertion hole 54 corresponding to the tapped hole 46 of the holding member 40 is formed at both ends in a direction shown by an arrow X.

Noryl resin and polyether imide are suitable for the ink supply member 42 in terms of resistance to ink, formability, and strength and others.

The elastic member 44 having a hole 56 corresponding to the ink supply port 26 of the head chip 12 is substantially tabular as shown in FIG. 3 and is integrated with the ink supply member 42 by forcing a press-fit part 58 protruded upward into the concave portion 52 shown in FIG. 4 of the ink supply member 42.

The elastic member 44 is formed by butyl rubber having the hardness of approximately 50° (Shore A). However, butyl rubber having another hardness or another material that meets performance such as sealing performance, resistance to ink, gas permeability and moisture permeability may be used.

A method of assembling the ink jet recording head 10 made up as described above will be described below.

As shown in FIG. 4, the elastic member 44 integrated with the ink supply member 42 is abutted with the head chip 12 fastened to the holding member 40 from the upside (in a direction shown by an arrow Z), positioning the ink supply port 26 and the hole 56. Next, the bolt 60 is inserted into the bolt insertion hole 54 of the ink supply member 42 and is screwed into the tapped hole 46 of the holding member 40. The elastic member 44 is compressed by the screwing of the bolt 60 and the distance between the holding member 40 (including the head chip 12) and the ink supply member 42 is reduced. As a result, the convex portion 50 is abutted with the holding member 40 and the distance between the holding member 40 and the ink supply member 42 is fixed. Therefore, the compressed amount of the elastic member 44 is fixed and a connection of the supply passage 48 and the ink supply port 26 is securely sealed.

The action of the ink jet recording head 10 made up as described above will be described below.

In the ink jet recording head 10, when ink is consumed by the jetting of ink droplets from the nozzles 18, ink is supplied to the individual passage 20 from a tank not shown via the supply passage 48 of the ink supply member 42, the ink supply port 26 of the head chip 12 and the common liquid chamber 22. Ink droplets are jetted from the nozzle 18 by heating the heater element 24.

Because the head chip 12, the ink supply member 42 and the elastic member 44 are different in the coefficients of linear expansion if the temperature of the ink jet recording head 10 rises due to such printing operation, thermal stress acts among each member, however, the thermal stress can be reduced by the elastic deformation of the elastic member 44.

Also, thermal stress acts between the head chip and the holding member 40 because of the rise of the temperature of the head chip 12 (the heater element board 14), however, the thermal stress is absorbed by a silicon-modified resin used for an adhesive.

Further, in the ink jet recording head 10, as the compressed amount of the elastic member 44 is provided by touching the convex portion 50 of the ink supply member 42 to the holding member 40 in assembly, the ink jet recording head 10 can secure stable sealing performance by the deformation by fixed compression of the elastic member 44 and it is also possible to prevent excessive pressure from acting upon the head chip 12 and damage it.

Also, as no adhesive is used for assembling the ink jet recording head 10 and the elastic member 44 is merely screwed with the bolt 60 between the ink supply member 42 and the head chip 12, the assembly is easy. Therefore, a device that requires high grade control is not required unlike the case where an adhesive is used.

Further, it is also possible to prevent misregistration between the ink supply port 26 and the supply passage 48 caused by thermal stress between the head chip 12 and the ink supply member 42 caused if the head chip 12 and the ink supply member 42 are fastened by thermal fusion.

As described above, the ink jet recording head 10 can be precisely and easily assembled.

In addition, as the ink jet recording head is assembled by screwing without using an adhesive, the head chip 12, the holding member 40, the ink supply member 42 and the elastic member 44 respectively made of different materials can be easily detached. Therefore, the ink jet recording head is excellent in that fractionation is possible for recycling.

In this embodiment, the elastic member 44 is substantially tabular, however, it is also possible to form a convex rib on the side of the head chip 12 and thereby to secure satisfactory sealing performance by compressing the rib by predetermined amount. For example, sealing performance can be secured by compressing the height of the rib 0.8 mm wide and 0.8 mm high by 0.3 mm.

In this embodiment, the bolt 60 is used for fixing the ink supply member 42 and the holding member 40, however, other methods that can maintain the compressed amount of the elastic member 44 may be used.

Second Embodiment

Next, an ink jet recording head equivalent to a second embodiment of the invention will be described. The same reference numbers are allocated to the same components for those in the first embodiment and a detailed description is omitted.

Figure 6A:
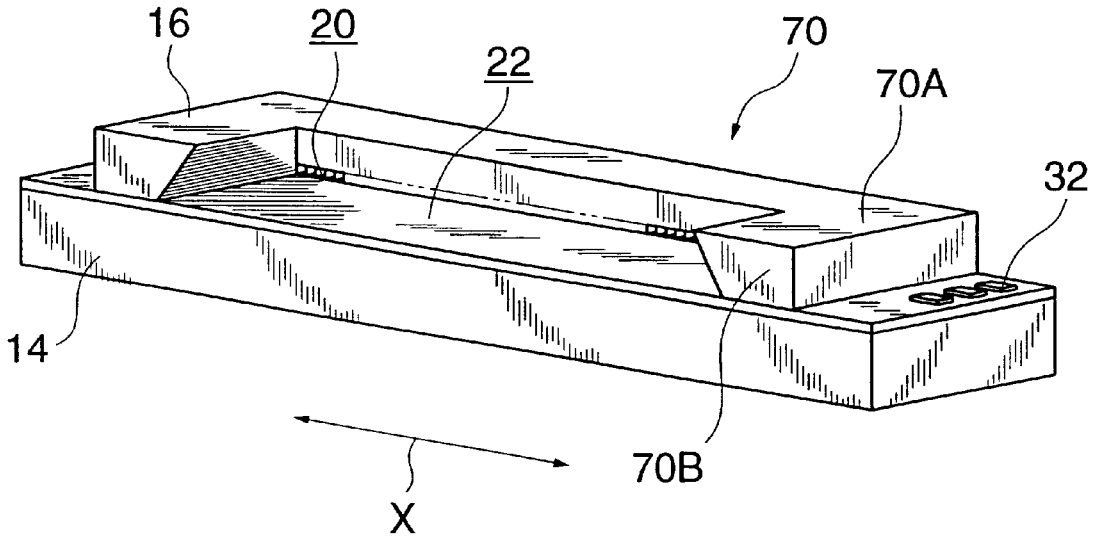
FIG. 6A is a perspective view showing the front side of a head chip in a second embodiment of the invention and FIG. 6B is a perspective view showing the back side of the head chip.
Figure 6B:
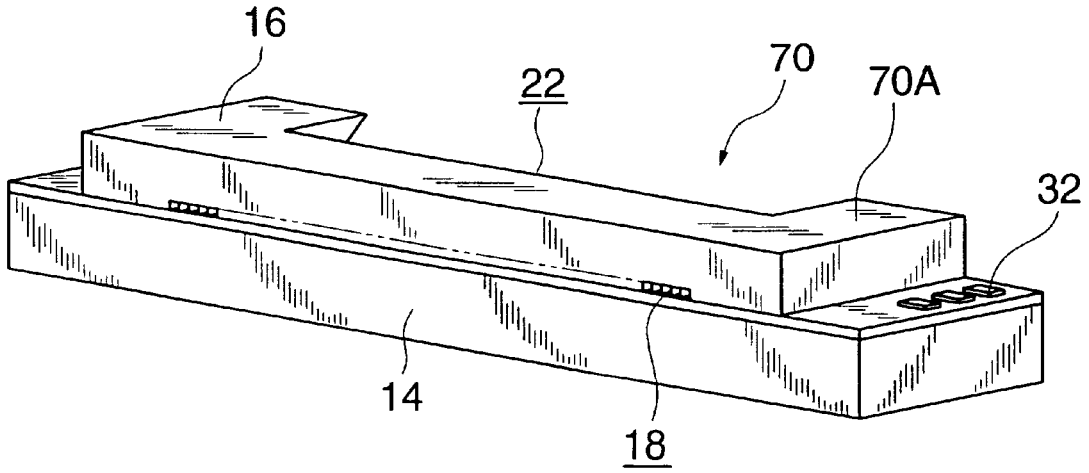

As shown in FIGS. 6A and 6B, a common liquid chamber 22 provided to a head chip 70 is not only open to the upside of a passage board 16 but is open to the back (the end face opposite to a nozzle 18) 70B. The opening is equivalent to the ink supply port in the first embodiment. As described above, to form the head chip 70, an electric signal input-output terminal 32 is formed at both ends in the longitudinal direction offset from a position in which the nozzle 18 (an individual passage 20) is formed in the longitudinal direction (a direction shown by an arrow X) of a heater element board 14.

Figure 7:
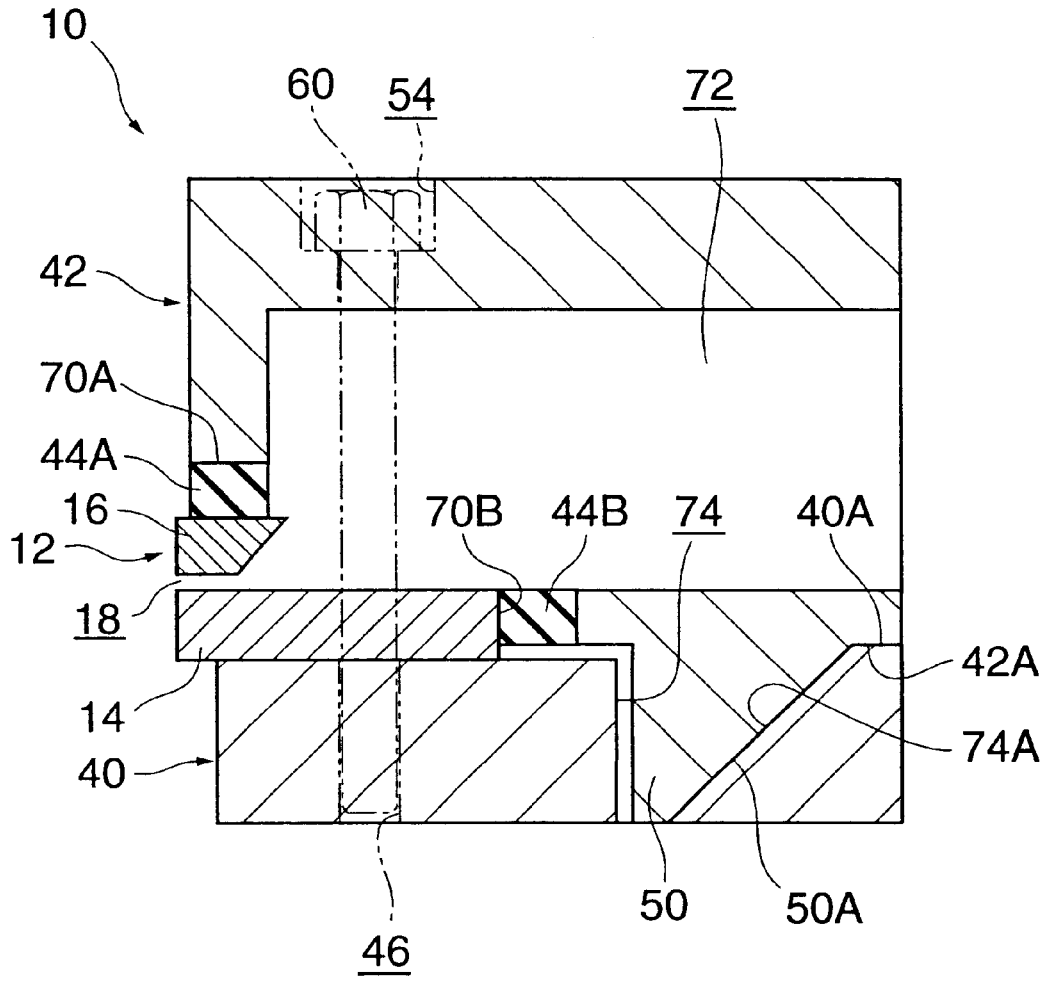
FIG. 7 is a longitudinal section showing an ink jet recording head equivalent to the second embodiment of the invention.
Figure 8:
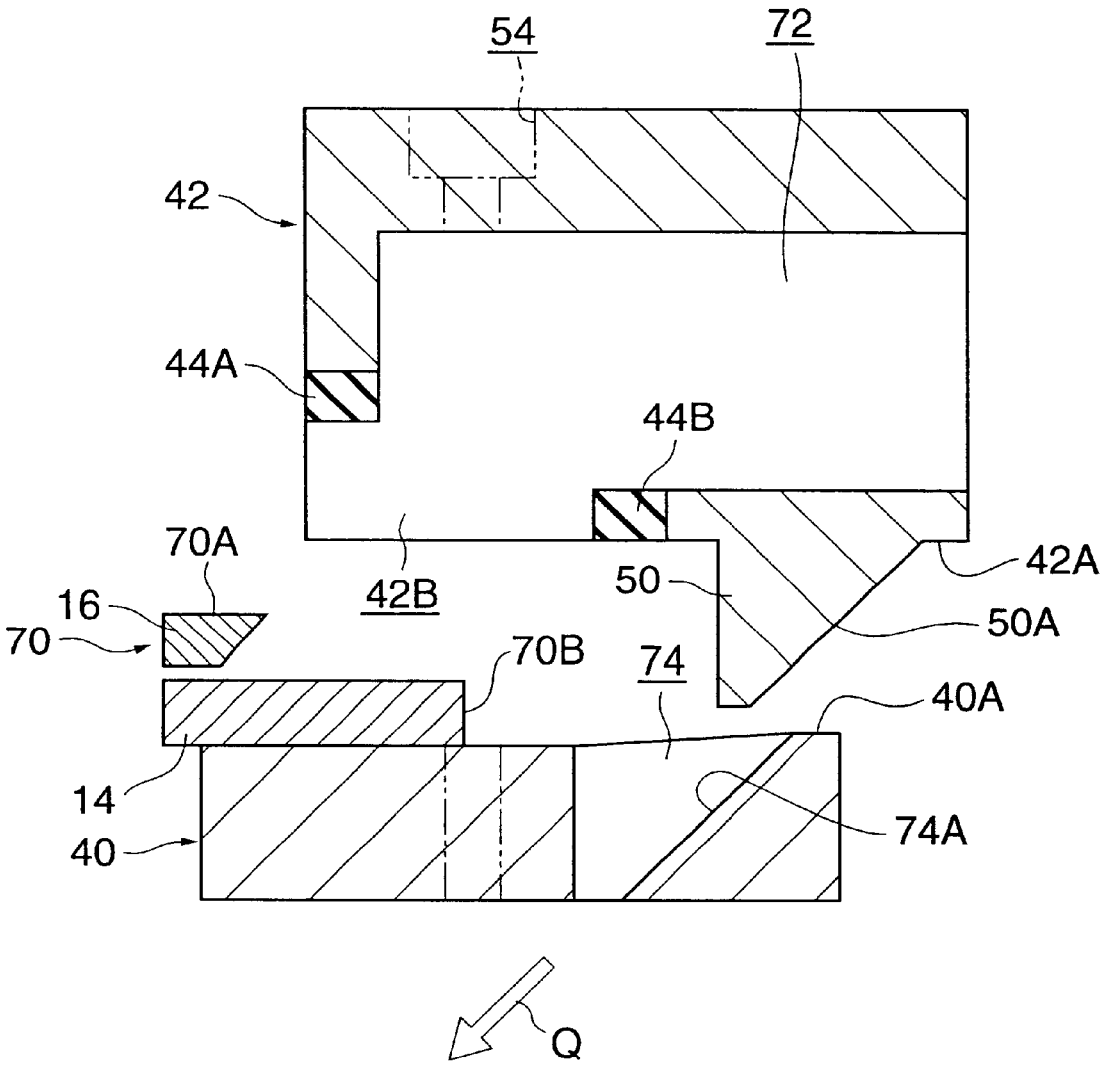
FIG. 8 is an assembly state explanatory drawing showing the ink jet recording head equivalent to the second embodiment of the invention.

In the meantime, as shown in FIG. 7, an ink supply member (an ink subtank) 42 that supplies ink to the head chip 70 includes a rectangular ink subchamber 72 inside and an elastic member 44 that can be pressed on the head chip 12 from two directions is included in one opening 42B shown in FIG. 8 near which the head chip 70 is installed. The elastic member 44 includes an elastic member 44A that seals the side of the upper surface 70A of the head chip 70 and an elastic member 44B that seals the back side 70B. In this embodiment, the elastic member 44 made of thermoplastic elastomer and the ink supply member 42 made of thermoplastic are integrated by multicolor injection molding. At this time, the sealing performance of the respective elastic member 44 and ink supply member 42 is secured by adjusting adhesion between the thermoplastic elastomer and the thermoplastic and the shape of a connection, and both can be formed so that they have strength in which they can be simply detached.

A convex portion 50 having the inclined face 50A the section of which is trapezoidal is formed in the lower part of the ink supply member 42 as shown in FIG. 8 and the head chip 70 is sealed by inserting it into a guide groove 74 of the holding member 40. The guide groove 74 has the inclined face 74A tilted at 45° upward on the back side 70B of the head chip 70 and the ink supply member 42 approaches the holding member 40 at an angle of 45° from the top on the back side 70B by sliding the inclined face 50A of the convex portion 50 on the inclined face 74A.

A method of assembling the ink jet recording head 10 will be described below.

To assemble the ink jet recording head 10, first, the convex portion 50 of the ink supply member 42 is inserted into the guide groove 74 of the holding member 40. At this time, the ink supply member 42 approaches the head chip 70 at an angle of 45° from the top (in a direction shown by an arrow Q) at the rear by sliding the inclined face 50A of the convex portion 50 on the inclined face 74A of the guide groove 74 and inserting it into the guide groove 74. As a result, the elastic members 44A and 44B integrated with the ink supply member 42 are respectively pressed on the upper surface 70A and the back 70B of the head chip 70. At this time, as the lower surface 42A of the ink supply member 42 is abutted with the upper surface 40A of the holding member 40, distance between the ink supply member 42 and the holding member 40 is provided and the elastic members 44A and 44B are compressed by predetermined amount.

The action of the ink jet recording head 10 made up as described above will be described below.

As the inclined face 50A of the convex portion 50 of the ink supply member 42 is slid along the inclined face of the guide groove 74 of the holding member 40 and the convex portion 50 is inserted into the guide groove when the ink jet recording head 10 is assembled, the elastic member 44 is pressed on the head chip 70 at an angle of 45° from the top on the back side 70B. Therefore, the elastic members 44A and 44B are respectively pressed on the upper surface 70A and the back 70B of the head chip 70 with predetermined pressure and sealing performance between the common liquid chamber 22 and the ink subchamber 72 is secured.

Particularly, in this embodiment, the heater element board 14 forming the common liquid chamber 22 and the wall of the ink supply member 42 including the ink subchamber 72 continue, sealing performance by the elastic member 44B is more satisfactory.

In addition, as the distance between the ink supply member 42 and the holding member 40 is fixed because the lower surface 50B of the convex portion 50 is abutted with the upper surface 40A of the holding member 40, the compressed amount of the elastic members 44A and 44B is fixed, sealing performance is secured and the head chip 70 is prevented from being damaged by excessive force that acts upon the head chip 70.

In the meantime, in the ink jet recording head 10, there is no boundary between the ink subchamber 72 and the common liquid chamber 22 and they look integrated. Therefore, the flow of ink supplied from an ink tank not shown to the individual passage 20 via the ink subchamber 72 and the common liquid chamber 22 is linear, resulting in smooth ink supply.

Also, the common liquid chamber 22 is substantially large-sized by integrating the ink subchamber 72 and the common liquid chamber 22 and as bubbles generated in the common liquid chamber 22 are made apart from the individual passage 20 and others, printing failure caused due to inhibition of ink supply is prevented.

Bubbles generated by the driving of the heater element 24 are easily moved from the common liquid chamber 22 to the ink subchamber 72 by setting an ink jetted direction to a direction of gravity, that is, downward, and printing failure by bubbles can be inhibited.

Third Embodiment

Next, referring to FIG. 9, an ink jet recording head equivalent to a third embodiment of the invention will be described. The same reference numbers are allocated to the same components for those in the first and second embodiments and a detailed description is omitted. In this embodiment, no ink supply member is shown.

Figure 9:
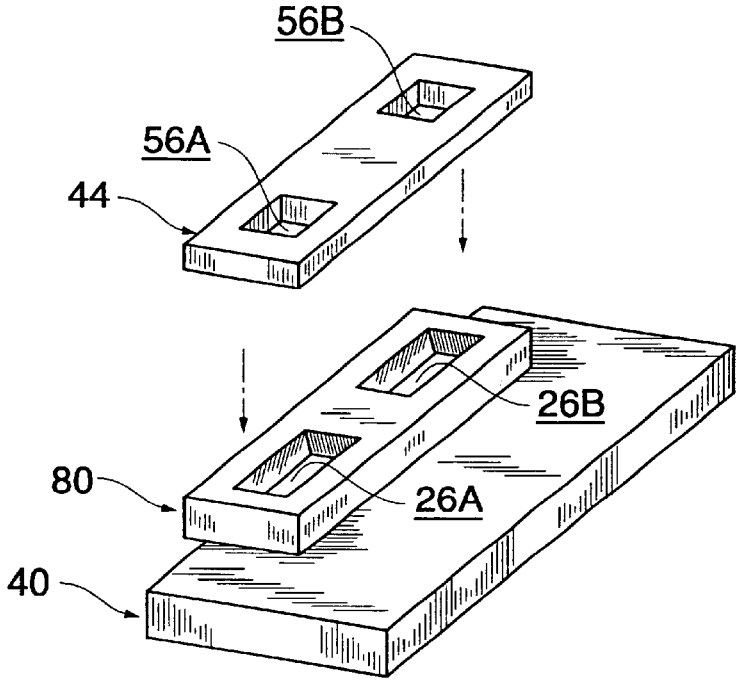
FIG. 9 is a schematic exploded perspective view showing an ink jet recording head equivalent to a third embodiment of the invention.

As shown in FIG. 9, a head chip 80 includes two ink supply ports 26A and 26B formed on the upper surface 80A.

In the meantime, an elastic member 44 includes holes 56A and 56B corresponding to the ink supply ports 26A and 26B.

Therefore, the ink supply ports 26A and 26B can be respectively securely sealed by pressing the elastic member 44 on the head chip 80. As a result, since respective connections of two supply passages of an ink supply member not shown and the ink supply ports 26A and 26B can be independently sealed, the ink jet recording head that can print in plural colors can be formed.

Fourth Embodiment

Figure 10:
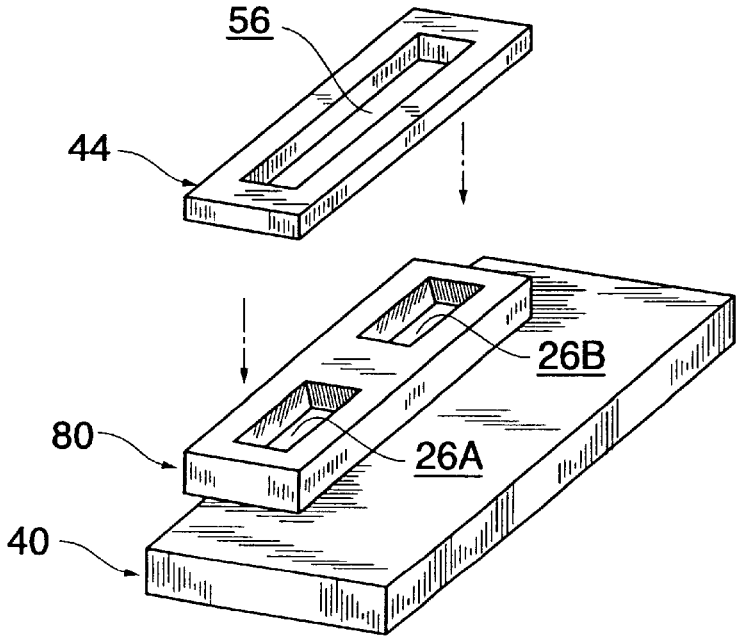
FIG. 10 is a schematic exploded perspective view showing an ink jet recording head equivalent to a fourth embodiment of the invention.

Referring to FIG. 10, an ink jet recording head equivalent to a fourth embodiment of the invention will be described below. The same reference numbers are allocated to the same components for those in the first to third embodiments and a detailed description is omitted.

In the ink jet recording head 10, an elastic member 44 provided with the similar hole 56 to that in the first embodiment is pressed upon a head chip 80 provided with two ink supply ports 26A and 26B. As a result, the ink supply ports 26A and 26B are sealed by the elastic member 44 and are integrated by the hole 56. That is, ink supplied from an ink supply member not shown via the elastic member 44 can be supplied to the plural ink supply ports 26A and 26B of the head chip 80. Therefore, this embodiment is effective when one color of ink is supplied to plural communicating ports.

Fifth Embodiment

Figure 11:
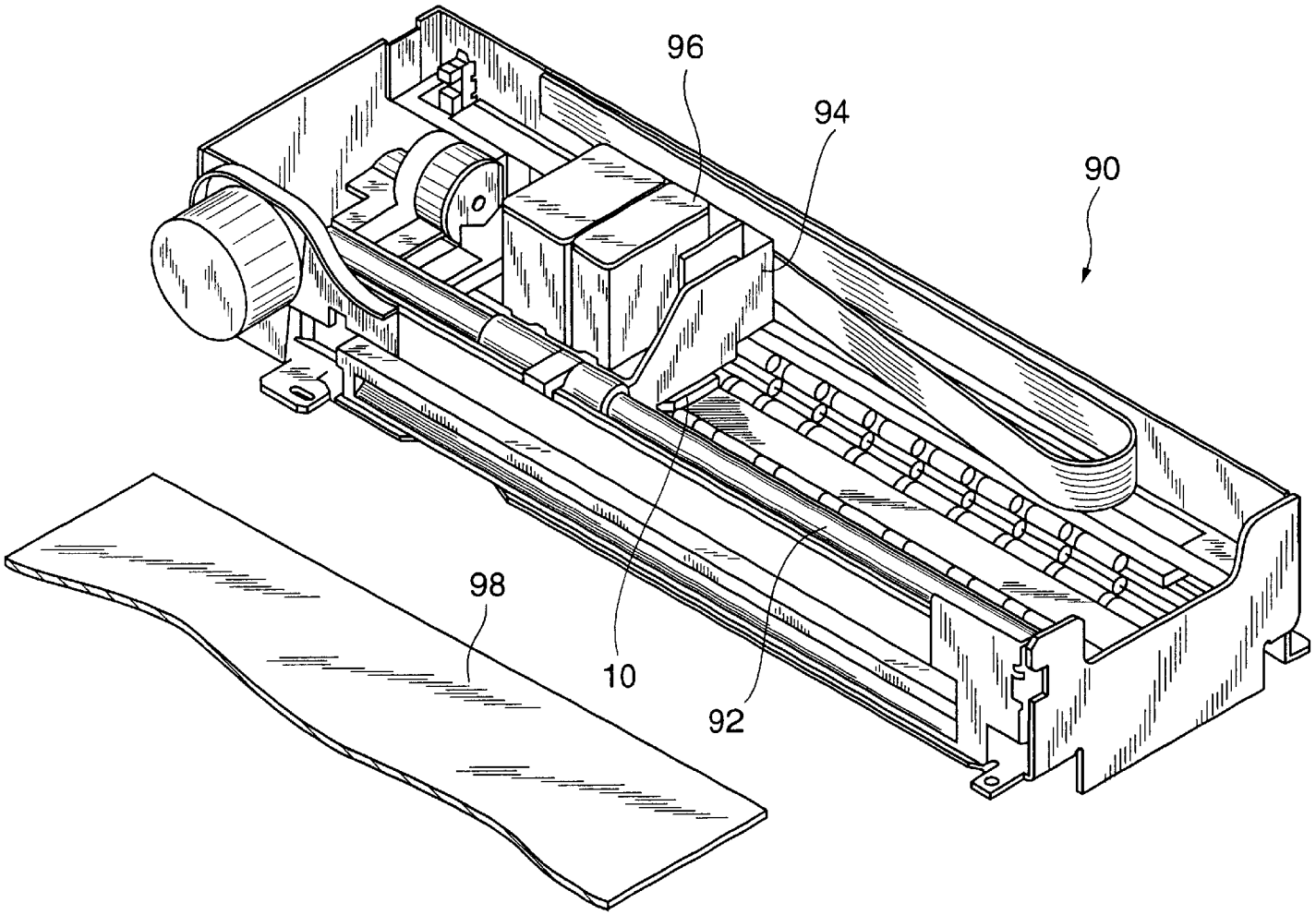
FIG. 11 is a perspective view showing an ink jet recording device equivalent to a fifth embodiment of the invention.

Referring to FIG. 11, an ink jet recording device equivalent to a fifth embodiment of the invention will be described below. The same reference numbers are allocated to the same components for those in the first to fourth embodiments and a detailed description is omitted.

FIG. 11 is a schematic perspective view showing an example of the ink jet recording device provided with the ink jet recording head in each embodiment.

The ink jet recording device 90 is provided with an ink feeder 96 loaded onto a carriage 94 run along a guide shaft 92 and the ink jet recording head 10 (not limited to the one in the first embodiment).

As the sealing performance of the ink jet recording head 10 is satisfactorily secured by making up the ink jet recording device 90 as described above, jetting performance for stable printing can be secured.

A record medium 98 includes all the recordable media such as paper, a postal card and cloth. The record medium 98 is carried to a position corresponding to the ink jet recording head 10 by a carriage mechanism.

According to the invention, the ink jet recording head in which the ink supply member and the head chip are precisely joined by a simple method can be provided. In addition, as each part of the ink jet recording head can be simply detached, recycling is easy.

The entire disclosure of Japanese Patent Application No. 2000–145424 filed on May 17, 2000 including specification, claims, drawings and abstract is incorporated herein by reference in its entirety.

What is claimed is:

1. An ink jet recording head, comprising:

a head chip having a plurality of substrates for providing a nozzle, an individual passage for supplying ink to the nozzle and a common liquid chamber for supplying ink to plural individual passages;

an ink supply member having a wall adjacent to the head chip for forming an integrated ink chamber conjugated with the common liquid chamber; and a pressed elastic member which is provided between the ink supply member and the head chip and which seals a connection between the wall and the head chip.

2. The ink jet recording head according to claim 1, further comprising:

a regulator that regulates a deformed amount by pressure of the elastic member.

3. The ink jet recording head according to claim 2, further comprising:

a holding member to which the head chip is fixed, wherein the regulator is formed in at least one of the ink supply member and the holding member and comes into contact with the other as a contacting part in assembly.

4. The ink jet recording head according to claim 3, wherein the holding member comprises a guide unit that guides the ink supply member, when the ink supply port is open in the two directions, so that the elastic member is pressed upon the head chip from an intermediate direction of the two directions.

5. The ink jet recording head according to claim 1, further comprising:

a maintenance unit that maintains a deformed state of the elastic member.

6. The ink jet recording head according to claim 5, wherein the maintenance unit is a fixing member that fixes the ink supply member to the holding member in a state in which a connecting part is in contact with the holding member.

7. The ink jet recording head according to claim 1, wherein at least two of the head chip, the ink supply member and the holding member are different in a coefficient of thermal expansion.

8. The ink jet recording head according to claim 1, wherein the elastic member and the ink supply member are fabricated and integrated by insertion molding.

9. The ink jet recording head according to claim 1, wherein the elastic member is pressed in a concave portion formed in the ink supply member and is integrated therewith.

10. The ink jet recording head according to claim 1, wherein the elastic member made of thermoplastic elastomer and the ink supply member made of thermoplastic are integrated by multicolor injection molding.

11. The ink jet recording head according to claim 1, wherein a hole formed in the elastic member makes plural ink supply ports and one pipeline communicate with each other by inserting the elastic member between the ink supply member and the head chip.

12. The ink jet recording head according to claim 1, wherein plural holes formed in the elastic member make plural ink supply ports and plural pipelines formed in the ink supply member and the head chip, respectively, communicate with each other by inserting the elastic member between the ink supply member and the head chip.

13. The ink jet recording head according to claim 1, wherein the head chip, the elastic member and the ink supply member can be detached.

14. An ink jet recording head, comprising:

a head chip formed by laminating silicon substrates and provided with a nozzle, an individual passage for supplying ink to the nozzle and a common liquid chamber for supplying ink to plural individual passages;

an ink supply member a wall of which is formed adjacent to a wall of the head chip forming the common liquid chamber and which is provided with an ink chamber integrated with the common liquid chamber; and an elastic member which is inserted between the head chip and the ink supply member and which seals a connection of the ink chamber and the common liquid chamber.

15. An ink jet recording device, comprising:

the ink jet recording head according to claim 1.

* * * * *